US005341121A

United States Patent [19]

Rada

[11] Patent Number: 5,341,121

[45] Date of Patent: Aug. 23, 1994

[54] DIFFERENTIAL SCORE INDICATOR SYSTEM FOR BASKETBALL

[76] Inventor: J. Glenn Rada, 312 Littletown Quarter, Williamsburg, Va. 23185

[21] Appl. No.: 994,342

[22] Filed: Dec. 21, 1992

[51] Int. Cl.[5] ..... G08B 23/00

[52] U.S. Cl. ..... 340/323 R; 364/411; 273/1.5 R; 273/1.5 A; 377/5; 235/1 B

[58] Field of Search ..... 340/323 R, 780, 789; 364/411; 377/2, 5, 39, 45; 235/1 B, 90; 116/38, 222, 247, 250, 281; 40/559

[56] References Cited

U.S. PATENT DOCUMENTS

| | | | |
|---|---|---|---|
| 2,423,725 | 7/1941 | Poole | 377/5 |
| 2,978,676 | 7/1950 | Spencer | 340/323 |
| 3,868,671 | 2/1975 | Maguire et al. | 340/323 |
| 3,959,640 | 5/1976 | Syria | 116/222 |
| 4,215,501 | 8/1980 | Meijer | 40/559 |
| 5,039,977 | 8/1991 | Mele et al. | 364/411 |
| 5,164,715 | 11/1992 | Kashiwabara et al. | 340/782 |

*Primary Examiner*—John K. Peng
*Assistant Examiner*—Daryl C. Pope
*Attorney, Agent, or Firm*—Wallace J. Nelson

[57] ABSTRACT

A separate differential score display unit is provided at each end of a basketball court, atop or beside of the shot time clock indicators presently used, and in position to be as visible to the players and coaches as is the shot time clock indicators. The differential score display units are color coded, e.g. home team lead shown by green light, or L.E.D.; visitor lead shown in red. The differential score display units may be (1) hard wired to the scoring table and main scoreboard with computerized controls automatically changing the differential display when the score changes; (2) hard wired directly to a separate scoring control; or (3) the differential score display units adapted to receive differential scoring input from suitable signal transmitting units controlled by the scoring table panel. The electrical circuitry employed to give the differential display is a modified hand-held or table top calculator type circuitry wherein instead of displaying the minus sign (as in the calculator circuit), when the visiting team leads in scoring the "red" display is actuated simultaneously with inactivation of the "green" display.

10 Claims, 3 Drawing Sheets

DIFFERENTIAL SCORE INDICATOR SYSTEM FOR BASKETBALL

Field of the Invention

This invention relates generally to sports scoring indicator systems and relates specifically to a differential score indicator system for basketball contests.

BACKGROUND OF THE INVENTION

In most all sporting events, a continuous running score indicator system is desirable for providing information to the players, coaches and spectators. In basketball, informational scoring systems presently include indication of the total scores for the home and visiting teams, total team fouls, time remaining in the play period, as well as shot time clocks. What has heretofore been missing is a score indicating system whereby spectators, players and coaches are able to determine, at a glance, the score differential between the competing teams. By using the indicated total team scores, the players and coaches may mentally calculate the difference in total score between the two teams but this requires some mental effort and distracts from the concentration sometimes needed in the game.

It is therefore an object of the present invention to add a differential score indicator to presently used basketball scoring systems.

Another object of the present invention is a differential scoring system for basketball games that is visible to the spectators, the participating players and coaches of the opposing teams.

A further object of the present invention is a differential scoring indicator for basketball games that is positioned adjacent the shot time clocks presently employed.

An additional object of the present invention is a differential scoring indicator for basketball games that is color coded to indicate the team having the differential advantage.

A still further object of the present invention is a differential scoring indicator for basketball games that is controlled from the scoring table and simultaneously changed when the total score indication on the main score board is changed.

SUMMARY OF THE INVENTION

According to the present invention the foregoing and additional objects are attained by providing a separate differential score indicator unit, of square or rectangular configuration, at each end of a basketball court, atop, beside the shot time clock indicator presently used, or completely and independently located, and in position to be as visible to the spectators, players and coaches as is the shot time clock indicator. The differential score indicators display an illuminated numeral representing the score differential between the home and visiting teams. The displayed numeral is color coded, e.g. home team lead shown by green light, or L.E.D.; visitors lead shown in red. In one aspect of the invention, the differential score display units are hard wired to the scoring table with computerized controls automatically changing the differential display when the score changes. In another aspect of the invention, the differential score display units receive their inputs directly from a separate scoring control panel, while in a third aspect of the invention, the differential score display units receive their inputs through either hard wire connections or through suitable radio signals or infrared sending diodes.

BRIEF DESCRIPTION OF THE DRAWINGS

A more complete appreciation of the invention and many of the attendant advantages thereof will be better understood when considered in connection with the accompanying drawings wherein.

DETAILED DESCRIPTION

Figure 1:
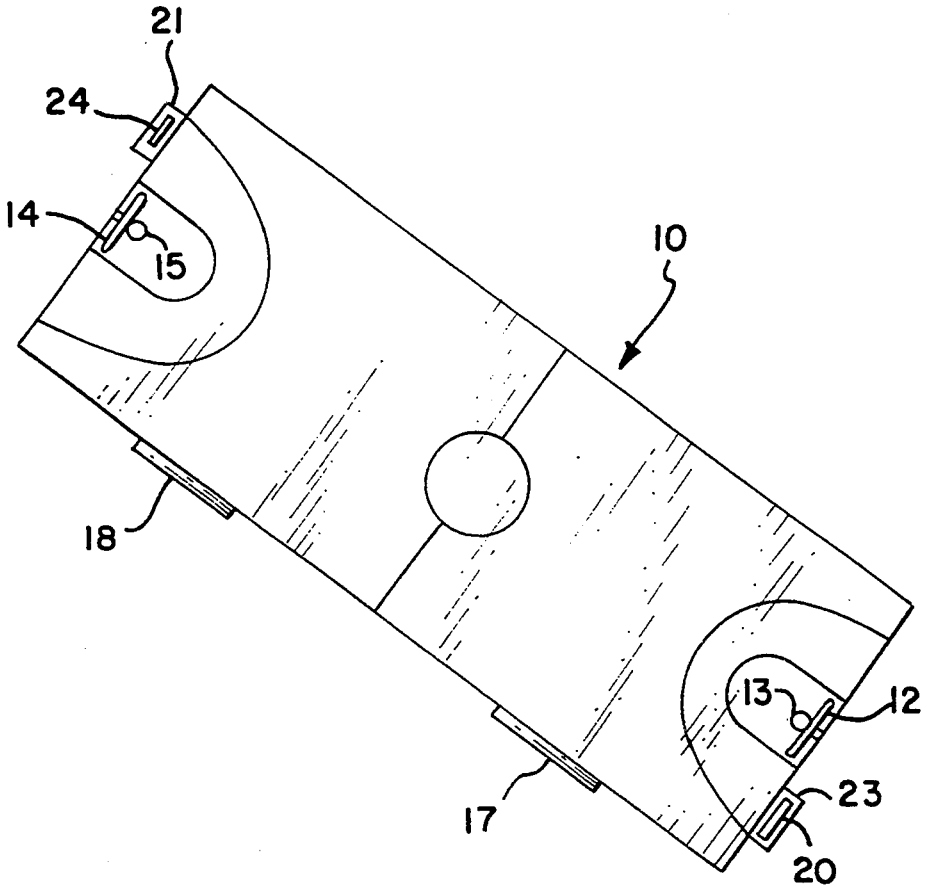
FIG. 1 is a schematic top elevation view of a basketball court having the differential score indicator units of the present invention positioned atop the shot time clock indicators.

Referring now to the drawings and more particularly to FIG. 1, a schematic top elevation of a typical basketball court is shown and designated generally by reference numeral 10. Basketball court 10 includes a conventional backboard and goal at each end thereof as designated by respective reference numerals 12, 13, and 14, 15. Player benches 17, 18 are disposed on opposite sides of the center line adjacent the ends of basketball court 10, in a conventional manner. Shot time clocks 20, 21 are provided at opposite ends of court 10.

Figure 2:
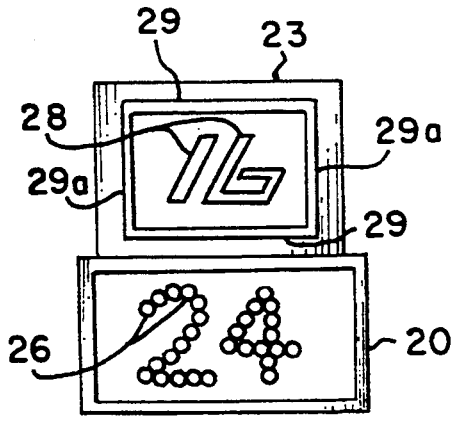
FIG. 2 is a front elevation view of one of the differential scoring indicator units of the present invention and shot time clock indicators shown in FIG. 1.

A differential score indicator unit of square, rectangular or other configuration, is disposed atop each of shot time clocks 20, 21 in the embodiment of FIG. 1, as designated by reference numerals 23, 24. The numerical light display for shot time clock 20 (FIG. 2) is produced by multiple white incandescent bulbs 26, while the numerical display in differential score unit 23 is produced by selective green or red light emissive diodes (L.E.D.) 28. Suitable white light may be employed in lieu of the L.E.D. display with the selective green and red effect being provided by flood lights contained within the display units 23,24. To achieve the green and red color scheme when white or incandescent light is employed for the score indicia display, separate and selective banks of green 29, and red 29*a*, flood lights are provided along the respective horizontal and vertical boundaries of differential score display units 23,24.

Figure 3:
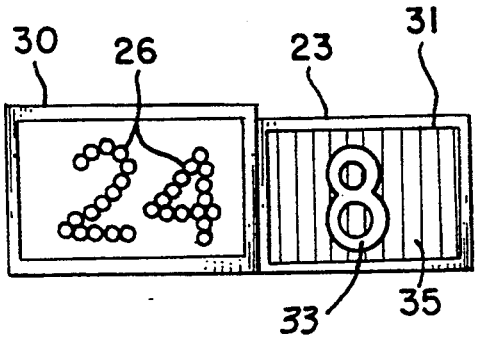
FIG. 3 is a view similar to FIG. 2 and illustrating one of the differential scoring indicator units positioned beside of a shot time clock indicator.

Referring to FIG. 3, a modified arrangement for shot time clock 30 and differential score indicator unit 31 is shown. The numerical display for shot time clock 30 is again provided by multiple white incandescent light bulbs 26. The numerical display 33 for differential score unit 31 is provided with a suitable white light source and filter shutter 35, selectively moved to provide either a green or a red transparent filter, over light display 33.

Figure 4:
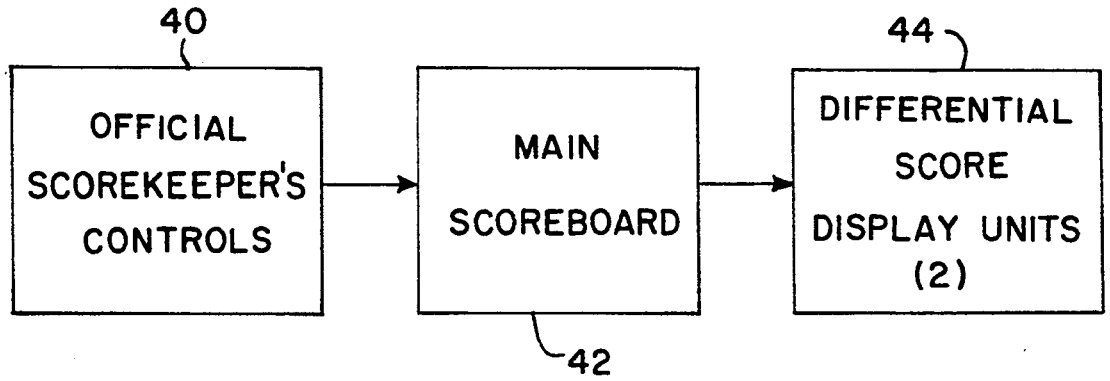
FIG. 4 is a block diagrammatic representation of the connected scoring table controls, main scoreboard and differential scoring indicator unit, according to one aspect of the present invention.

FIG. 4 is a schematic block diagram showing the interconnection between the official score keeper controls 40, main scoreboard 42 and differential score indicator units, represented in this FIG by block 44. In this arrangement, when the official score keeper enters a score on the main scoreboard, a computerized entry is also transferred to the differential score indicator units to reflect the differential change in score.

Figure 5:
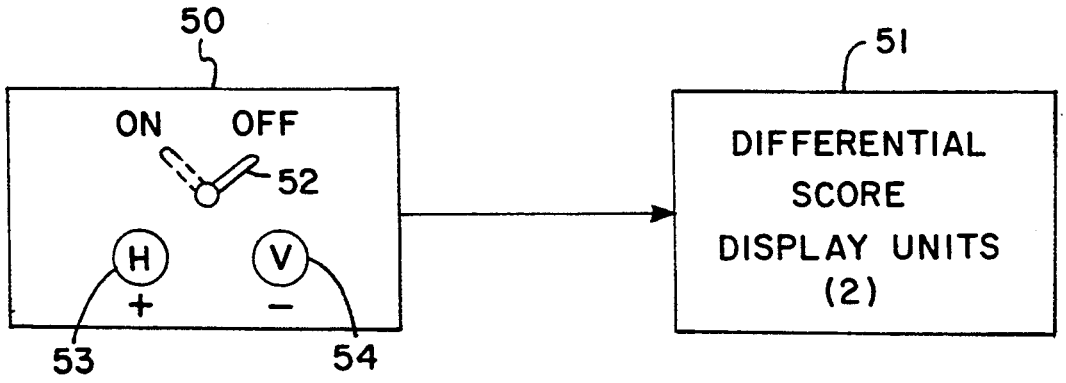
FIG. 5 is a block diagrammatic representation of one embodiment of direct controls leading from the scoring table to the differential scoreboards.

In FIG. 5, a schematic block diagram is shown indicating independent controls for operation of the differential score display units (e.g. 23, 24 of FIG. 1). In this embodiment, a separate control panel 50 is employed to actuate the differential score display units (represented by block 51). Control panel 50 is provided with a toggle switch 52 that is movable between an "ON" and "OFF" position to activate a suitable power supply (not shown) for operating the system. The power supply may be any suitable and conventional battery power supply contained within panel unit 50, or disposed external thereof. Also, conventional electric current may be employed as the power supply, if so desired.

Panel 50 also includes a pair of control buttons 53,54 labeled "H" and "V", respectively, to designate the game participants as the Home and Visitor teams. The "H" button is also labeled with a positive (+) sign while the "V" button is labeled with a negative (−) sign. Toggle switch 52 and buttons 53, 54 actuate circuitry similar to that employed in conventional hand-held or desk-top calculators.

This circuitry is designed such that when toggle switch 52 is turned to the "ON" position a positive numeral "1" is entered on each of the score display units. This display is displayed in green, with the color being effected, either by a Light Emissive Diode (L. E. D.), a green filter, or a green flood light, as described hereinbefore. By depressing button 54 (labeled "V" and "−"), this numeral "1" is replaced by "0" with the lighting remaining green. By depressing button 54 a second time, the "0" is changed to "1" with the lighting being simultaneously changed to red through the control circuitry. This function is identical to that of the calculators except instead of displaying a negative (−) sign for the read-out as in the calculators), the lighting color is changed. Depressing button 53 ("H") again changes the display back to "0" and the lighting color back to green.

This routine is used to test operation of the differential score display system prior to start of the basketball game. Once the game is in progress, buttons 53 and 54 are selectively depressed, one time each, for each point scored by the respective Home or Visitor team to give a continuous display of the differential score between the teams on the differential score display units (denoted by block 51 ). Thus, either button 53 (Home team), or 54 (Visiting team), is depressed one time for a free throw, two times for regular field goals and three times for three-point goals.

Figure 6:
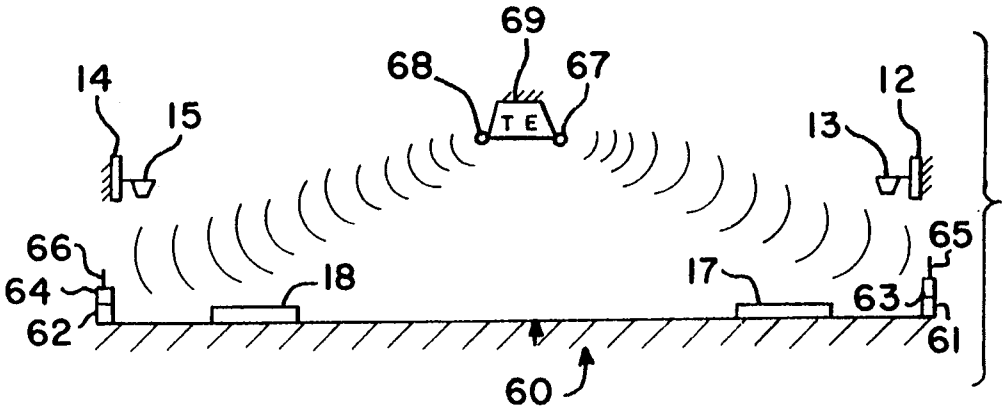
FIG. 6 is a schematic side elevation view of a basketball court employing signal sending transmitters to convey differential scoring information to the differential score display units according to another aspect of the present invention.

Referring now to FIG. 6, an alternate embodiment of the invention employing signal broadcasting units will now be described. The conventional basketball court in this embodiment is shown in schematic side elevation and designated generally by reference numeral 60. Basketball court 60 is provided with conventional backboards 12,14 having respective goals 13,15 attached thereto, as described hereinbefore in reference to FIG. 1. A pair of team benches 17,18 are disposed adjacent the ends and on opposite sides of the center line on basketball court 60, as also described in reference to FIG. 1. A pair of shot time clocks 61,62 are provided on opposite ends of court 60 and support respective differential score display units 63,64. Differential score display units 63,64 are provided with respective signal receiving antenna 65,66 serving to receive differential input from the respective signal sending units 67,68 disposed on main scoreboard 69. Signal sending units 67,68 are selected from the group of signal sending units consisting of radio signal sending units and infrared sending diodes.

Figure 7:
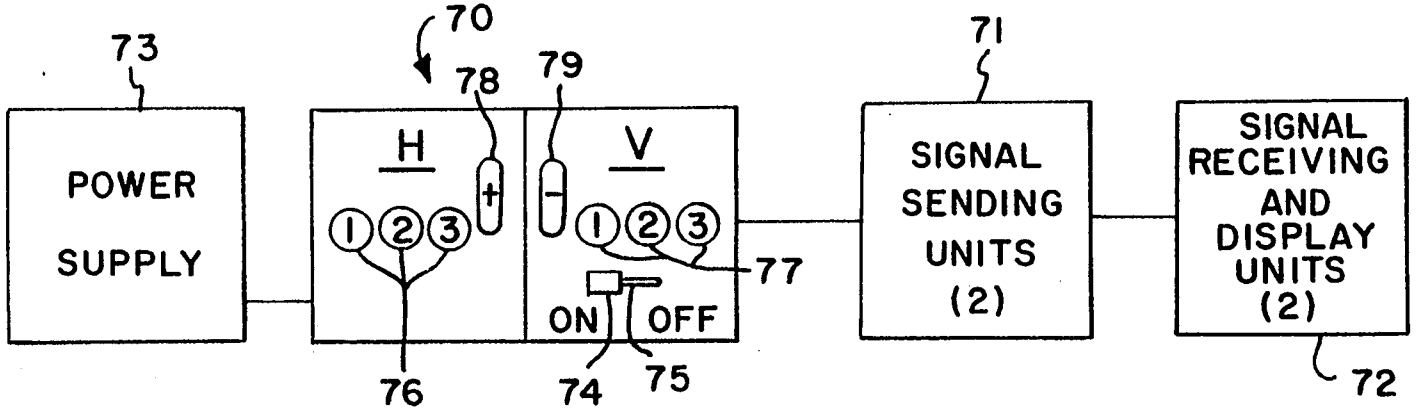
FIG. 7 is a schematic view of the scoring table controls, signal sending transmitters and signal receiver and display units employed in the embodiment illustrated in FIG. 6.

Referring to FIG. 7, a schematic representation of an alternate embodiment of the official score controls is shown. In this embodiment, a control panel 70 is employed to convey differential score information, via signal senders 67,68 (FIG. 6), to the signal receiving antenna 65,66 and differential score indicating units 63,64. The receiving antenna and differential score indicating units are represented by respective blocks 71 and 72 in this FIG.

The power supply for operating the circuitry controlled by panel 70 is represented by block 73. Power supply 73 may be contained within panel block 70 or separate therefrom and may consist of a conventional battery or conventional electric current, as so desired. The circuitry controlled by panel 70 is also similar to that of hand-held or table top calculators and is not further described herein in the interest of brevity. As illustrated, panel 70 is divided into two sections labeled "H" and "V" and representing, respectively, the Home and Visiting teams. These two sections are preferably provided with contrasting colors, e.g. green for the "H" or Home team and red for the "V" or Visitors. Alternatively, the individual keys on the separate sections may be provided with respective green and red colors.

A suitable on-off switch 74 is slidably movable along groove 75 to permit selective activation/inactivation of power supply 73 to the circuitry controlled by panel 70. A row of three push buttons is provided along each respective "H" and "V" side of panel 70 and designated by reference numerals 76,77. The three buttons in each row of rows 76 and 77 are labeled "1", "2", and "3". An elongated rectangular button is disposed adjacent each row series of buttons 76,77 and labeled, respectively, with a positive (+) and a negative (−) symbol. The positive (+) elongated rectangular button is denoted by reference numeral 78, while the negative (−) rectangular button is denoted by reference numeral 79. Positive button 78 is disposed on the green or "H" side of panel 70 while the negative (−) button 79 is disposed on the red or "V" side of panel 70.

The circuitry controlled by panel 70 operates in a similar manner to that described hereinbefore in reference to FIG. 5. When switch 74 is moved to the "ON" position shown, a signal is transmitted to block 71 (denoting signal sender units 67, 68). These senders transmit a signal to antenna 65,66 that is converted to a digital read-out "0" that is displayed (in green) on differential score indicating units 63,64.

To test the system, either of "H" buttons 76 may be depressed and the function entered on display units 63,64 by depressing the "+" entry button 78. The comparable function button 77 is then depressed on the "V" side and entered by depressing the "−" button 79. This subtracts the positive function previously entered and a green "0" reappears on the display units 63,64. A subsequent entry of another negative or "V" key changes the green "0" to a red display of the function entered. After re-setting the display units to "0" the system is ready for use.

If desired, the two sets or series of buttons 76,77 may be reduced to a single set of three buttons employed in combination with the positive and negative entry buttons 78,79. The use of the series of three buttons is employed in this embodiment to correspond to the respective value of free throws, regular field goals and three point goals as an aid to the differential score keeper or panel operator. This avoids multiple depressing of the single entry button as in the embodiment of FIG. 5.

If so desired, control panel 70 may be hard wired to the differential display units and the intermediate signal sending and receiver units omitted. Also, as described hereinbefore in reference to FIG. 4, the control panels 50 and 70 may be omitted completely and the circuitry employed to control the total home and visitor scores on scoreboard 69 being modified to include a computer addition therein that simultaneously computes the score differential upon entry of any score with this differential information being conveyed to the differential display units directly or through the signal sending units.

Control panel embodiments 50 and 70 are particularly useful when adding differential display units to existing systems but may not be as desirable when installing completely new scoring systems. In each of the embodiments described, the necessary power supply for operating the lights and circuitry in the display units may be provided by its own internal battery power supply or obtained directly from the same power supply employed in the shot time clocks, and is not further explained herein in the interest of brevity. Suitable on-off switches and/or plug-in connections (not shown) are provided on the individual differential display units, as needed.

As discussed hereinbefore, the details of the various electric circuitry have been omitted herein in the interest of brevity, it being understood that this state of the art technology is not considered the point of novelty of the present invention.

Thus, although the invention has been described relative to specific embodiments thereof, it is not so limited and there are numerous variations and modifications of the invention, as described, that will be readily apparent to those skilled in the art in the light of the above teachings.

It is therefore to be understood that the specific examples described herein are to be deemed as exemplary and are not to be considered as exhaustive and that, within the scope of the appended claims, the invention may be practiced other that as specifically described herein.

What is claimed as new and desired to be secured by Letters Patent of the United States is:

1. A basketball game scoring system for displaying the differential score between two basketball teams and employed with a basketball court having a playing surface with a pair of player benches disposed on a side thereof comprising, in combination:

a visible differential score display unit disposed at each end of the basketball court;

each said differential score display unit facing the playing area of the basketball court and in position to be seen by spectators, game participants on the basketball court and by the occupants of both team benches;

each said visible differential score display unit being provided with color coded indicia means to indicate the score differential between the home and visiting basketball teams during a game; and operator actuated remote control means to control and change the color of said color coded indicia means as needed while the game is in progress.

2. The basketball scoring system of claim 1 including a shot time clock display unit disposed at each end of the basketball court and wherein each said visible differential score display unit is disposed in adjacent relationship with one of said shot time clock display units.

3. The basketball scoring system of claim 2 wherein the adjacent relationship of each said differential score display unit relative to one of said shot time clock display units is selected from positions atop, beneath and in side-by-side relationship with one of said shot time clock display units.

4. The basketball scoring system of claim 1 wherein said color coded indicia means indicating the score differential between the home and visiting basketball teams is provided with a green color when the home team is leading the score and a red color when the visiting team has the score lead.

5. The basketball scoring system of claim 1 wherein said operator actuated remote control means to control and change the color coded indicia includes a control panel connected to a power supply and individual keys on the control panel to permit selective activation and deactivation of the power supply and to add and subtract numerical units indicated on the color coded indicia means and, including electrical circuitry controlled by said individual keys to change the color of the color coded indicia means depending upon which team has the leading score.

6. The basketball scoring system of claim 1 wherein the color for the color coded indicia is provided by red and green light emissive diode.

7. The basketball scoring system of claim 1 wherein the color for the color coded indicia means is provided by incandescent light in combination with green and red flood lights; each said differential score display units having a configuration including a vertical pair of sides and a horizontal pair of sides; and said green and red flood lights being disposed on said horizontal and vertical sides of said configuration.

8. A basketball game scoring system for displaying the differential score between two basketball teams and employed with a basketball court having a playing surface with player benches disposed on a side thereof comprising, in combination:

a visible differential score display unit disposed at each end of the basketball court;

said differential score display unit facing the playing area of the basketball court and in position to be seen by spectators, game participants on the basketball court and by the occupants of both team benches;

each said visible differential score display unit being provided with color coded indicia means to indicate the score differential between the home and visiting basketball teams during a game;

operator actuated remote control means to control and change the color of said color coded indicia means as needed while the game is in progress;

said operator actuated remote control means including a control panel connected to a power supply and having individual keys thereon to activate and deactivate the power supply to the control panel and to produce signals corresponding to the differential score between the two team participants;

signal transmitting units for receiving and transmitting signals received from said control panel;

signal receiving antenna disposed on each said differential score display unit for receiving signals from said signal transmitting units;

each said differential score display unit converting signals received through said signal receiving antenna into a visible color coded display of the differential score between the two team participants.

9. The basketball scoring system of claim 8 wherein the color for the color coded indicia means is provided by a color source selected from the group of color sources consisting of green and red light emissive diodes; incandescent lights in combination with green and red flood lights; and incandescent lights in combination with green and red transparent filters.

10. The basketball scoring system of claim 8 wherein said control panel is divided into "Home" and "Visitor" color coded sections; said individual keys including a series of three keys in each said Home and said Visitor section; each said series of three keys being labeled as "1", "2" and "3"; and an entry key disposed in each said Home and said Visitor sections and adjacent each said series of three keys; said entry key disposed in said Home section being labeled "+" and said entry key disposed in said Visitor section being labeled "−".

* * * * *